US009463556B2

(12) United States Patent
Lefavour et al.

(10) Patent No.: US 9,463,556 B2
(45) Date of Patent: Oct. 11, 2016

(54) CRIMP TOOL FORCE MONITORING DEVICE

(71) Applicant: Hubbell Incorporated, Shelton, CT (US)

(72) Inventors: John David Lefavour, Litchfield, NH (US); Alan Douglas Beck, Bow, NH (US); Robert Michael Poirier, Bedford, NH (US); Peter Matthew Wason, Manchester, NH (US); Lawrence N. Brown, Ctr Barnstead, NH (US)

(73) Assignee: Hubbell Incorporated, Shelton, CT (US)

( * ) Notice: Subject to any disclaimer, the term of this patent is extended or adjusted under 35 U.S.C. 154(b) by 722 days.

(21) Appl. No.: 13/800,684

(22) Filed: Mar. 13, 2013

(65) Prior Publication Data

US 2013/0240228 A1 Sep. 19, 2013

Related U.S. Application Data

(60) Provisional application No. 61/610,303, filed on Mar. 13, 2012.

(51) Int. Cl.

| | |
|---|---|
| ***B25B 27/10*** | (2006.01) |
| ***B25B 17/00*** | (2006.01) |
| ***H01R 43/042*** | (2006.01) |
| ***B25B 27/14*** | (2006.01) |
| ***B21D 39/04*** | (2006.01) |

(52) U.S. Cl.

CPC ..... *B25B 17/00* (2013.01); *B21D 39/048* (2013.01); *B25B 27/10* (2013.01); *B25B 27/146* (2013.01); *H01R 43/042* (2013.01); *H01R 43/0428* (2013.01)

(58) Field of Classification Search

CPC ..... H01R 43/042; H01R 43/0421; H01R 43/0427; H01R 43/0428; B25B 27/10; B25B 27/146; B21D 39/04; B21D 39/048

USPC ..... 173/20, 152, 171; 72/126, 402, 409.09, 72/409.18, 409.01, 413, 416, 453.16, 72/465.1, 20.1, 31.01; 29/237, 268, 751, 29/753; 174/84 C

See application file for complete search history.

(56) References Cited

U.S. PATENT DOCUMENTS

| | | | | | |
|---|---|---|---|---|---|
| 3,464,246 | A * | 9/1969 | Abromavage | G01R 31/024 | 29/593 |
| 3,523,351 | A * | 8/1970 | Filia | H01R 43/042 | 296/96 |
| 4,555,665 | A * | 11/1985 | Stanley | G01B 7/10 | 324/229 |
| 4,809,534 | A | 3/1989 | Osborn | | |
| 5,062,290 | A * | 11/1991 | Hoover | H01R 43/0427 | 100/231 |
| 5,197,186 | A * | 3/1993 | Strong | B30B 15/0094 | 29/705 |
| 5,277,050 | A * | 1/1994 | DeRoss | H01R 43/048 | 29/753 |

(Continued)

FOREIGN PATENT DOCUMENTS

DE 102007050176 4/2009

*Primary Examiner* — Scott A. Smith

(74) *Attorney, Agent, or Firm* — Michael Best & Friedrich, LLP

(57) ABSTRACT

A crimp tool includes a frame, a lead screw and a nut assembly connected to the lead screw. A spring member is connected to the frame and movable with rotation of the lead screw. A first transducer is connected to the nut assembly to measure a first force applied on the nut assembly. A second transducer is connected to the spring member to measure a second force applied thereon by the spring member.

3 Claims, 9 Drawing Sheets

(56) References Cited

U.S. PATENT DOCUMENTS 5,353,623 A * 10/1994 Bobenhausen ..... B21D 39/048 29/237
5,421,186 A * 6/1995 Lefavour ..... H01R 43/042 72/409.01
5,490,406 A 2/1996 College
5,704,110 A * 1/1998 Erhard ..... H01R 43/0486 29/33 M
5,824,906 A * 10/1998 Lohmann ..... B21D 39/048 73/597
6,035,775 A 3/2000 Nghiem
6,073,472 A 6/2000 Hollingsworth
6,164,106 A 12/2000 Nghiem
6,227,030 B1 5/2001 Lefavour et al.
6,244,085 B1 * 6/2001 Dummermuth ..... B25B 27/10 72/31.01
6,324,884 B1 * 12/2001 Barjesteh ..... B21D 39/046 29/237
6,457,338 B1 10/2002 Frenken
6,768,059 B1 * 7/2004 Lefavour ..... H01R 43/042 174/84 C
6,966,230 B2 * 11/2005 Frenken ..... B25B 27/10 73/819
6,996,913 B2 * 2/2006 Lum ..... G01B 7/12 33/550
7,036,806 B2 5/2006 Amherd et al.
7,059,166 B2 6/2006 Bowles et al.
7,143,626 B2 * 12/2006 Dole ..... B21D 39/04 29/237
7,181,942 B2 * 2/2007 Yost ..... H01R 43/048 29/705
7,461,448 B2 12/2008 Schwartzman et al.
8,079,242 B2 12/2011 Pacaud et al.
8,336,177 B2 * 12/2012 Vernasca ..... B21D 39/048 29/235
8,839,653 B2 * 9/2014 Roman, Jr. ..... B25B 27/10 29/751
2001/0011994 A1 * 8/2001 Morimoto ..... G06F 3/0338 345/156
2001/0035039 A1 * 11/2001 Ooji ..... H01R 43/055 72/420
2001/0047674 A1 * 12/2001 Meisser ..... H01R 43/0488 72/20.1
2005/0050702 A1 * 3/2005 Green ..... B25B 27/10 29/263

* cited by examiner

CRIMP TOOL FORCE MONITORING DEVICE

CROSS REFERENCE TO RELATED APPLICATION

This application claims the benefit under 35 U.S.C. §119 (e) of U.S. Provisional Application Ser. No. 61/610,303, filed Mar. 13, 2012, which is hereby incorporated by reference in its entirety.

FIELD OF THE INVENTION

The present invention relates to a force monitoring device for a crimp tool. More particularly, the present invention relates to a transducer connected to a hand tool to measure the crimping force. Still more particularly, the present invention relates to a crimp tool that determines whether conductor insulation is damaged during crimping to indicate a defective crimp.

BACKGROUND OF THE INVENTION

Measurement of a crimp force is of particular interest when crimping to ensure a good crimp is achieved, particularly when using small, hand-operated and battery operated mechanical crimp tools. Existing hand-operated and battery operated mechanical crimp tools do not indicate that a good crimp was achieved during a crimping process. Large crimp tools, such as hydraulic and pneumatic crimp tools, use pressure transducers that measure the operating pressure of the compressible fluid used to drive the crimp tool. The small mechanical crimp tools are hand-operated and, thus, do not have compressible fluid that can be measured to determine whether a good or bad crimp was obtained. Accordingly, a need exists for a mechanical crimp tool that measures a crimping force to determine whether a good or bad crimp was obtained.

Because mechanical crimp tools do not monitor the force applied during the crimping process, conductor insulation can be damaged by applying excessive force during the crimping process. Although such force typically does not damage the conductor, the insulation can split or otherwise be damaged, thereby creating a conductive path through the insulation. Accordingly, a need exists for a mechanical crimping tool that monitors connector insulation damage during the crimping process.

SUMMARY OF THE INVENTION

Accordingly, it is a primary objective of the present invention to provide a force measuring device for a hand-operated crimp tool.

A further objective of the present invention is to provide a crimp tool with a transducer to measure a crimping force.

Another objective of the present invention is to provide a crimp tool that indicates whether a crimping procedure resulted in a good or bad crimp.

Another objective of the present invention is to provide a crimp tool that determines whether connector insulation was damaged during crimping to indicate a defective crimp.

The foregoing objectives are basically attained by a crimp tool including a frame, a lead screw and a nut assembly connected to the lead screw. A spring member is connected to the frame and movable with rotation of the lead screw. A first transducer is connected to the nut assembly to measure a first force applied on the nut assembly. A second transducer is connected to the spring member to measure a second force applied thereon by the spring member.

The foregoing objectives are also basically attained by a crimp tool including a frame, a fixed conductive die connected to the frame, and a movable conductive die connected to the frame. A first non-conductive member is disposed between the frame and the fixed die. A second non-conductive member is disposed between the frame and the movable die. An electrical component is electrically connected to the fixed and movable conductive dies, such that an electrical circuit between the electrical component and the fixed and movable dies is closed during a poor crimp. The first and second non-conductive members prevent the electrical circuit from being closed during a good crimp.

The foregoing objectives are also basically attained by a method of crimping an object disposed in a crimp tool. A first force is measured with a first transducer during a crimping operation. A second force is measured with a second transducer during the crimping operation. Operating parameters of the crimp tool are determined from the first and second force measurements.

Other objects, advantages and salient features of the invention will become apparent from the following detailed description, which, taken in conjunction with the annexed drawings, discloses exemplary embodiments of the present invention.

As used in this application, the terms "front," "rear," "upper," "lower," "upwardly," "downwardly," and other orientational descriptors are intended to facilitate the description of the exemplary embodiments of the present invention, and are not intended to limit the structure thereof to any particular position or orientation.

BRIEF DESCRIPTION OF THE DRAWINGS

The above aspects and features of the present invention will be more apparent from the description for an exemplary embodiment of the present invention taken with reference to the accompanying drawings, in which.

Throughout the drawings, like reference numerals will be understood to refer to like parts, components and structures.

DETAILED DESCRIPTION OF EXEMPLARY EMBODIMENTS

Figure 1:
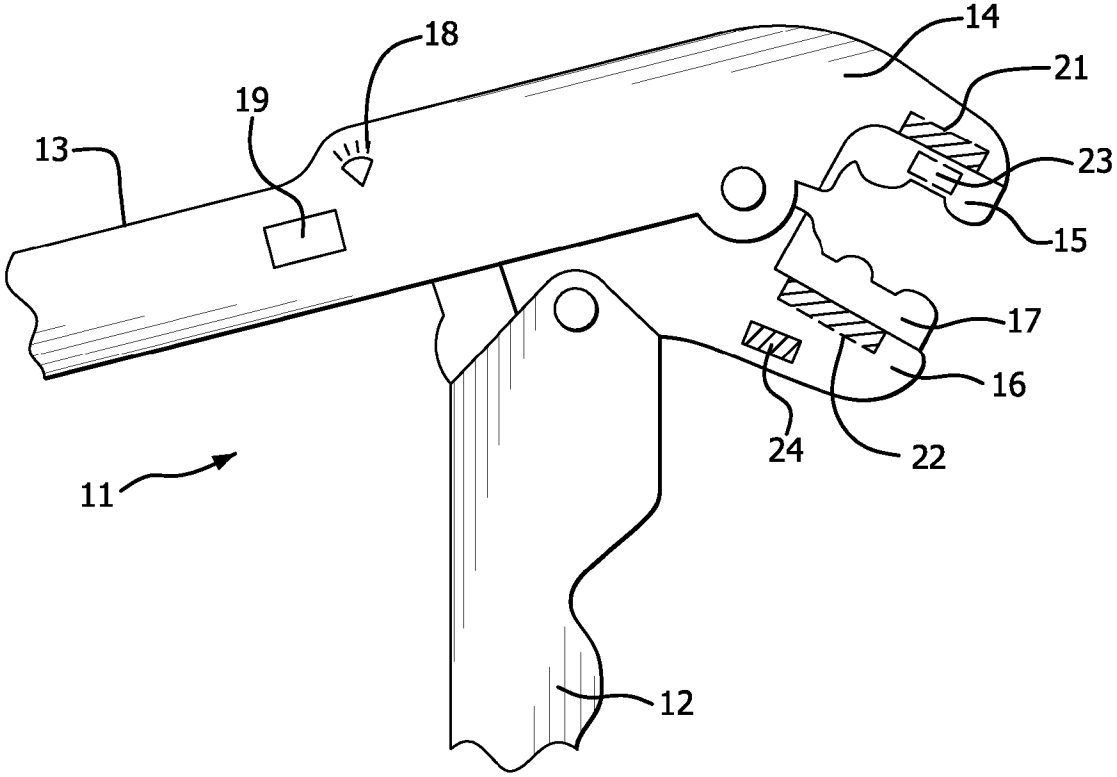
FIG. 1 is a partial side elevational view of a crimp tool according to a first exemplary embodiment of the present invention.

As shown in FIG. 1, a crimp tool 11 has a movable handle 12 and a fixed handle 13. An upper frame 14 for receiving an upper die 15 is connected to the fixed handle 13. A lower frame 16 receives a lower die 17. The lower frame 16 is pivotally connected between the moving handle 12 and the upper frame 14 of the fixed handle 13. An object to be crimped is inserted between the upper die 15 and the lower die 17, and the lower die 17 is pivoted toward the upper die 15 to crimp an object therebetween.

A conventional force transducer (load cell) 21 is connected to the crimp tool 11 to measure the operating pressure during the crimping process. The transducer 21 is disposed between the upper frame 14 and the upper die 15. Alternatively, the transducer can be disposed in any suitable location of the crimp tool 11. For example, a transducer 22 can be disposed between the lower frame 16 and the lower die 17. A transducer 23 can be disposed directly in a die, such as in the upper die 15. Alternatively, a strain gauge 24 can be used to replicate a transducer and can be mounted directly to a stressed member, such as to the lower frame 16. The transducer 22 measures the crimping force and converts such measurement to an electrical output, which can be sent to a microprocessor 19 for processing. After processing the received output, the microprocessor 19 can determine whether the applied force is indicative of a good or bad crimp by comparing the resultant value to predetermined target values stored therein.

An indicator 18 can provide a visible indication, such as a light, a tactile indication, such as a vibration, an audible indication, or a combination thereof to indicate whether a good or bad crimp was obtained. A microprocessor and battery 19 are electrically connected to the indicator 18 and the transducer or strain gauge and mounted on the crimp tool 11, such as in the fixed handle 13, to process the electrical output from the transducer 21, 22 or 23 or the strain gauge 24 to determine whether the obtained crimp is good or bad by measuring the crimp force.

Figure 2:
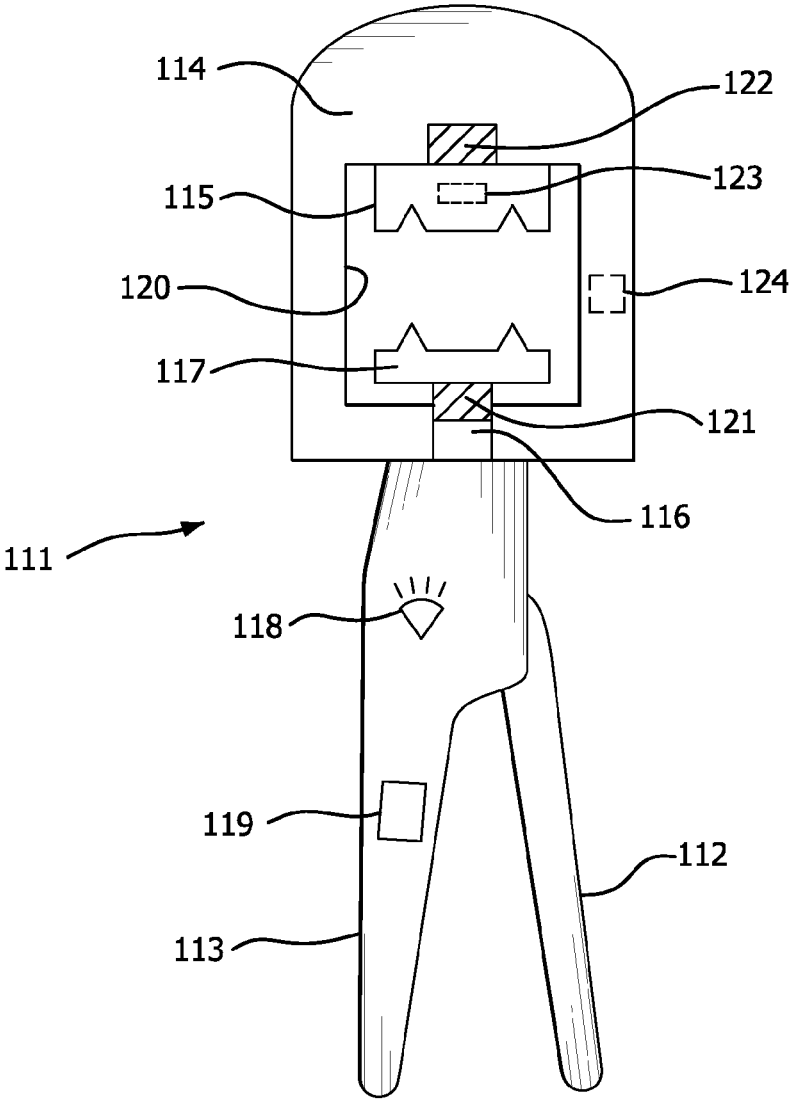
FIG. 2 is a front elevational view of a crimp tool according to a second exemplary embodiment of the present invention.

A crimp tool 111 in accordance with a second exemplary embodiment of the present invention is shown in FIG. 2. The crimp tool 111 has a movable handle 112 and a fixed handle 113. The movable handle 112 operates a ram 116 that is movable through a frame 114. A lower die 117 is connected to the ram 116. An upper die 115 is fixed to the frame 114. An object to be crimped is inserted through an opening 120 in the frame 114 and the ram 116 is driven upwardly to crimp the object between the lower die 117 and the upper die 115.

A conventional force transducer 121 is connected to the crimp tool 111 to measure the operating pressure during the crimping process. The transducer 121 is disposed on the crimp ram 116, as shown in FIG. 2. Alternatively, the transducer can be disposed in any suitable location of the crimp tool 111. For example, a transducer 122 can be disposed between the frame 114 and the upper die 115. A transducer 123 can be disposed directly in a die, such as in the upper die 115. A transducer can be disposed on a member between the crimp ram 116 and the lower crimp die 117. Alternatively, a strain gauge 124 can be used to replicate a transducer and can be mounted directly to a stressed member, such as to the frame 114.

An indicator 118 can provide an visible indication, such as a light, a tactile indication, such as a vibration, an audible indication, or a combination thereof to indicate whether a good or bad crimp was obtained. A microprocessor and battery 119 are connected to the indicator 118 and the transducer 121, 122 or 123, or the strain gauge 124 and mounted on the crimp tool 111, such as in the fixed handle 113, to process the electrical output from the transducer 121 to determine whether the obtained crimp is good or bad.

Figure 3:
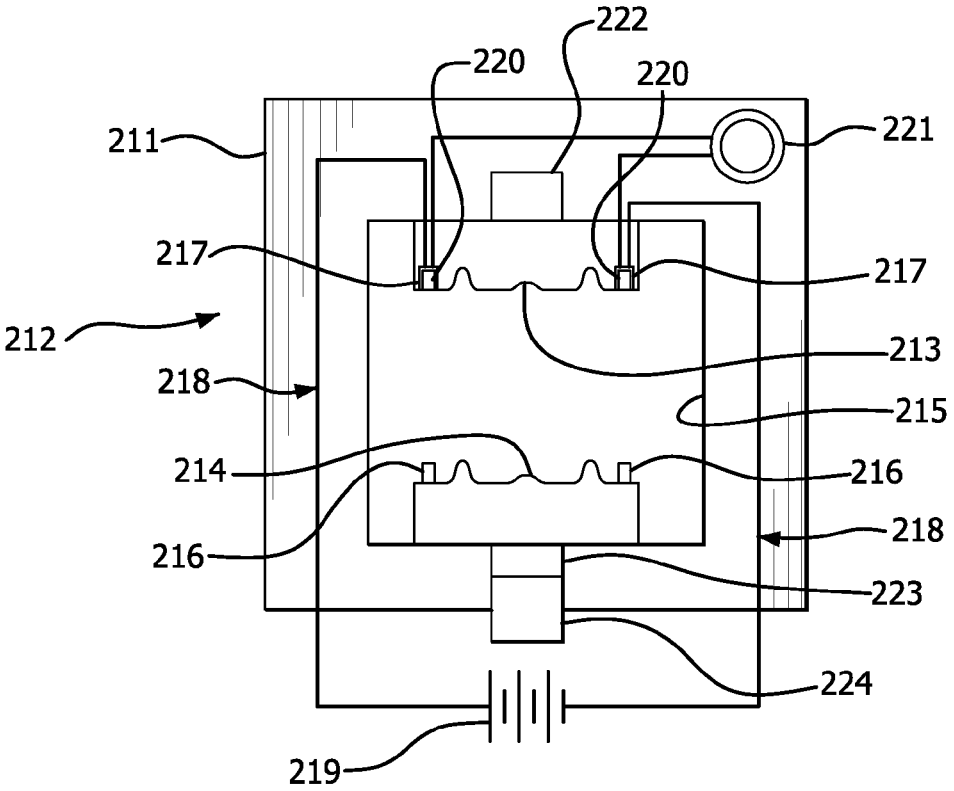
FIG. 3 is a front elevational view of a crimp tool according to a third exemplary embodiment of the present invention.

A frame 211 of a crimp tool 212 in accordance with a third exemplary embodiment of the present invention is shown in FIG. 3. An upper die 213 and a lower die 214 are disposed at opposite sides of an opening 215 in the frame 211. At least one pin 216 extends upwardly from the lower die 214. At least one corresponding slot 217 extends inwardly in the upper die 213 to receive the at least one pin 216 during the crimping process. A membrane switch 220 is disposed in each slot 217.

A conventional force transducer 222 is disposed between the frame 211 and the upper die 213. Alternatively, the transducer can be disposed in any suitable location of the crimp tool 211. For example, a transducer 223 can be disposed on a crimp ram 224. The crimp ram 224 is driven upwardly to move the lower die 214 connected thereto toward the upper die 213, thereby crimping an object disposed therebetween.

The membrane switches 220 form a circuit 218 including a battery 219 to power the circuit when the membrane switches in the slots 217 are energized. The membrane switches 220 are open when the pins 216 are not received in the slots 217, as shown in FIG. 3. The indicator 221 in this circuit can illuminate green to indicate proper contact between the pins 216 with the membrane switches 220 in the slots 217 and the target pressure is generated, and illuminate red when there is no contact between the pins 216 and the slots 217 and the target pressure is not obtained.

Figure 4:
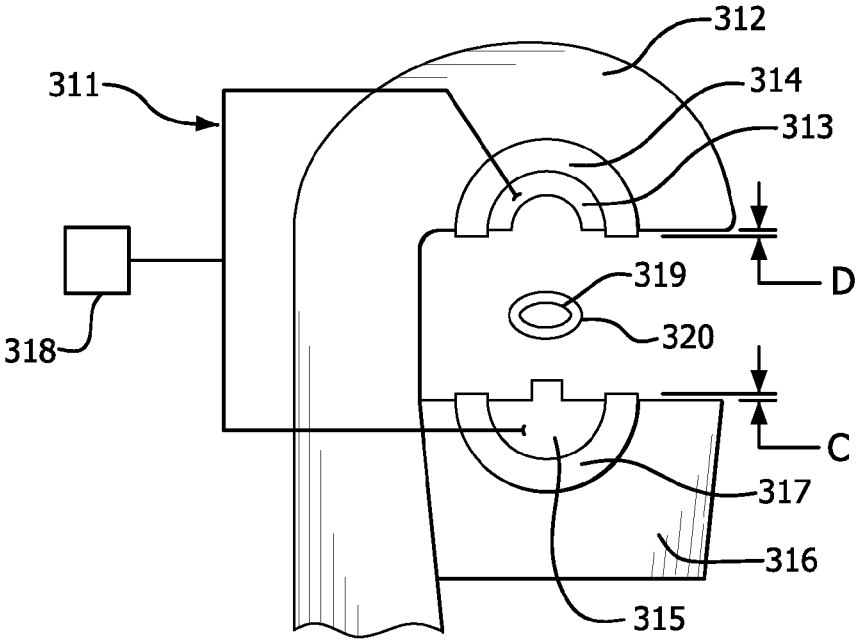
FIG. 4 is a partial front elevational view of a crimp tool in accordance with a fourth exemplary embodiment of the present invention.

A crimp tool 311 in accordance with a fourth exemplary embodiment of the present invention is shown in FIG. 4. A frame 312 has a fixed, conductive upper die 313 mounted to the frame 312 by a first non-conductive member 314. A movable, conductive lower die 315, such as an indenter, is mounted to a movable portion 316 of the frame 312 by a second non-conductive member 317. Each of the first and second non-conductive members 314 and 317 extends beyond the upper and lower dies 313 and 315, as indicated by distances C and D shown in FIG. 4. The upper and lower dies 313 and 315 are electrically connected to an ohm reader.

A connector 319 having insulation 320, such as vinyl or nylon insulation, is disposed between the upper and lower dies 313 and 315 to be crimped. When the insulation 320 on the connector 319 is damaged during crimping, the ohm reader 318 indicates that the insulation has failed. The upper and lower dies 313 and 315 are conductive, so a conductive path through the connector 319 occurs when the insulation 320 has failed during crimping, thereby generating a reading on the ohm reader 318. Accordingly, the absence of a reading on the ohm reader is indicative that the insulation 320 has not failed during crimping. The complementary surfaces of the non-conductive members 314 and 317 prevent contact between the conductive dies 313 and 315 during a crimp in which the insulation 320 is not damaged.

Figure 5:
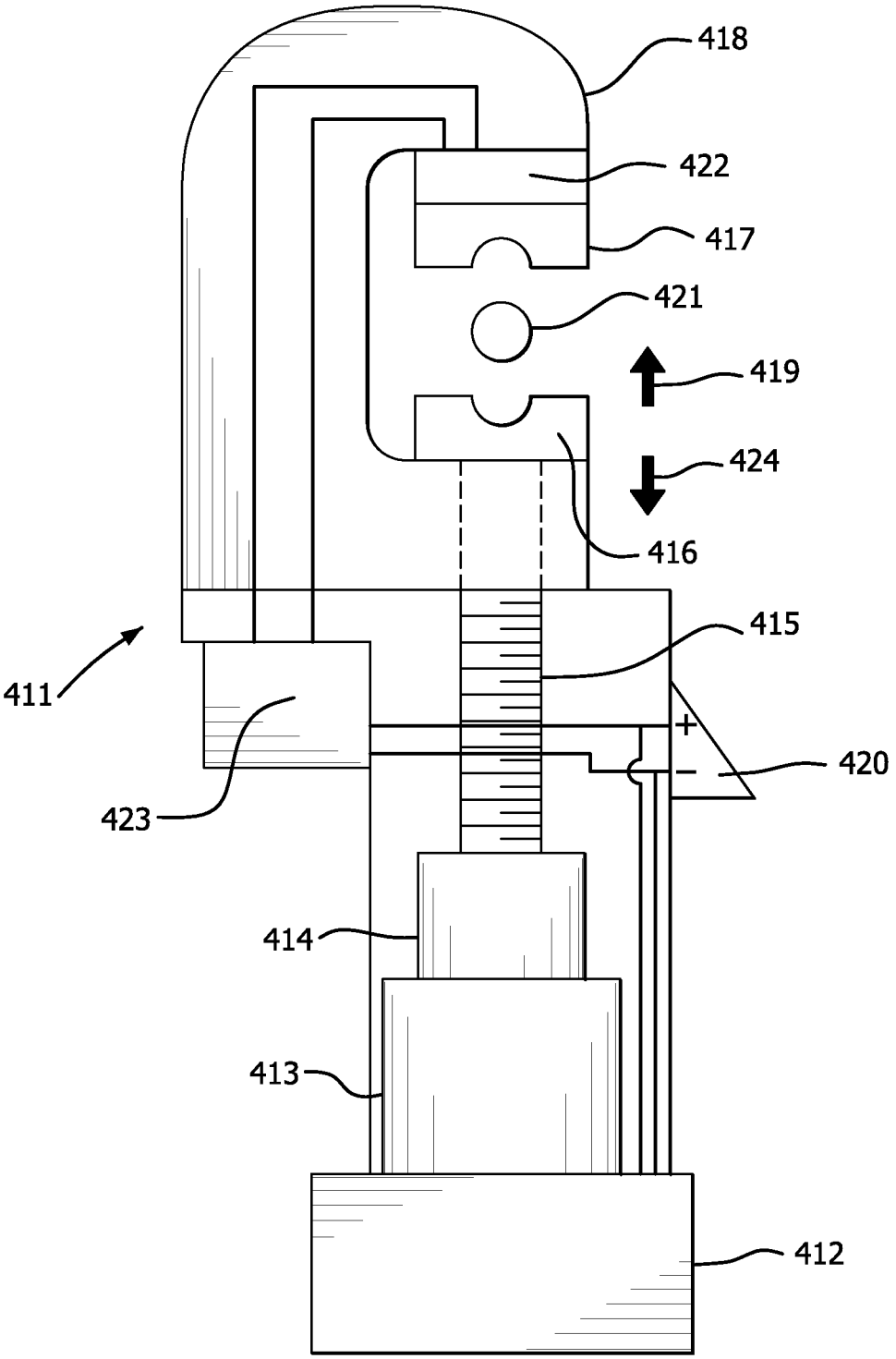
FIG. 5 is a side elevational view of a crimp tool in accordance with a fifth exemplary embodiment of the present invention.

A battery-powered crimp tool 411 in accordance with a fifth exemplary embodiment of the present invention is shown in FIG. 5. The crimp tool 411 includes a battery 412 for powering a motor 413 that drives a gear box 414. A ram 415 is advanced upwardly to move a lower crimp die 416 toward an upper crimp die 417 connected to a frame 418, as indicated by arrow 419 in FIG. 5. A trigger 420 is pressed by a user to supply power to the motor 413 to drive the ram lead screw 415. The trigger 420 is electrically connected to the battery 412. An object 421 to be crimped is inserted between the upper and lower dies 416 and 417.

A conventional force transducer 422 is connected to the crimp tool 411 to measure the output force during the crimping process. The transducer 422 is disposed between the frame 418 and the upper die 417. Alternatively, the transducer can be disposed in any suitable location of the crimp tool 411. The transducer 422 is electrically connected to a microprocessor 423, which is electrically connected to the battery 412.

To crimp the object 421, the user presses the trigger 420. The battery powers the motor 413 to drive the gear box 414 to advance the ram lead screw 415 upwardly, thereby crimping the object 421 between the lower and upper dies 416 and 417. When the object 421 is crimped, a force is applied to the transducer 422. When the force sensed by the transducer 422 reaches a predetermined value, the microprocessor 423 reverses the motor direction and retracts the ram lead screw 415 and lower die 416, as indicated by the arrow 424 in FIG. 5. Accordingly, the crimp tool 411 ensures that a good crimp is obtained.

Figure 6:
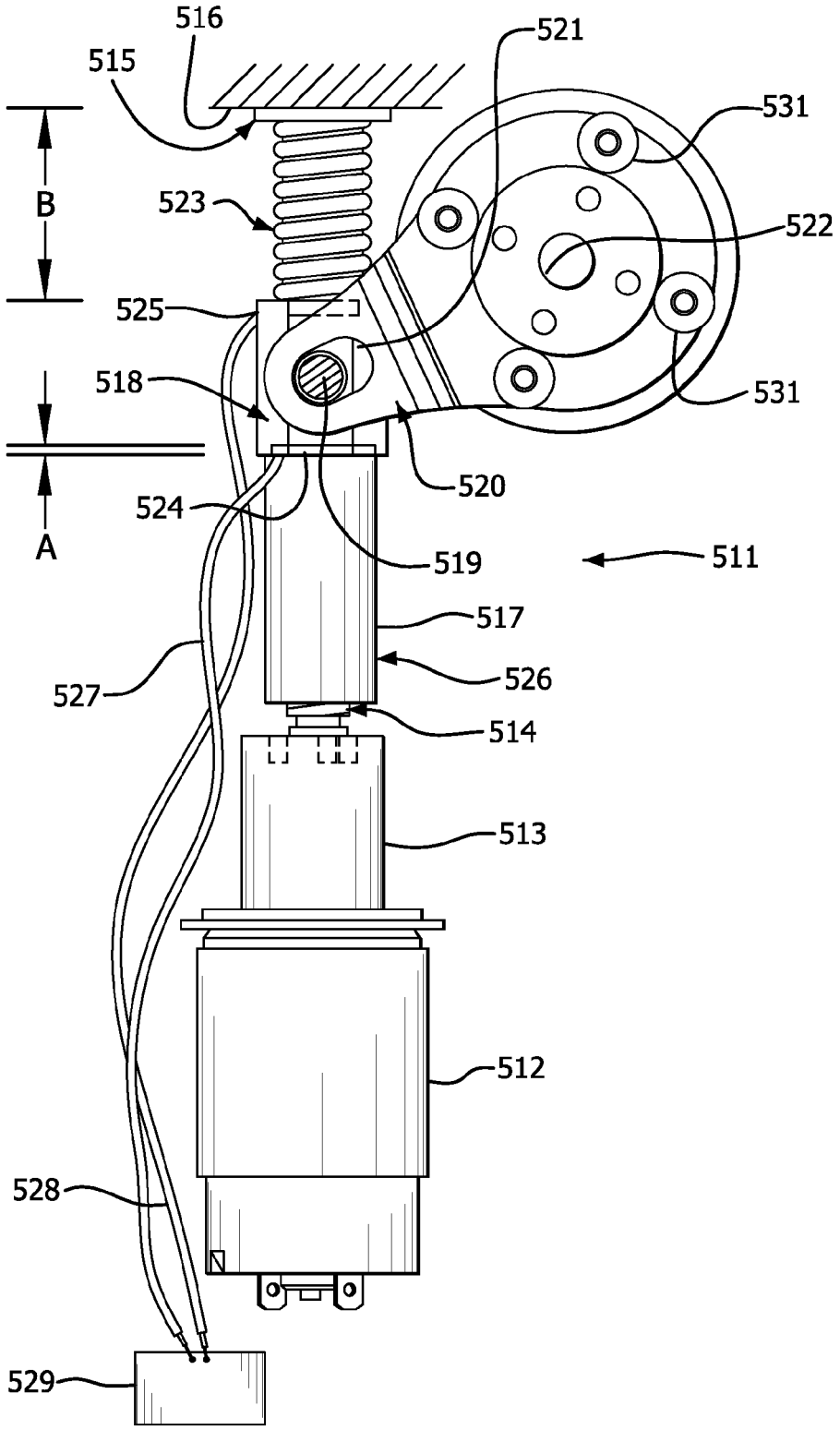
FIG. 6 is a rear elevational view of a crimp tool in accordance with a sixth exemplary embodiment of the present invention.

A powered crimp tool 511 in accordance with a sixth exemplary embodiment of the present invention is shown in FIG. 6. The crimp tool 511 includes a motor 512 that drives a gear box 513. A lead screw 514 is rotatably connected at a first end to the gear box 513 and to a bearing 515 mounted on a frame 516 at a second end. A nut assembly 526 includes a lower ball nut 517 and an upper collar 518 fixedly connected to the lead screw 514. A cam 519 is fixed to the upper collar 518 and is received by a slot 521 in a lever assembly 520.

To crimp an object, such as an electrical connector, disposed in an opening 522 of the lever assembly 520, the motor 512 drives the gear box 513 to advance the lead screw 514 upwardly. The upward movement of the lead screw 514 moves the lower ball nut 517 and upper collar 518 upwardly. Movement of the upper collar 518 upwardly moves the pin 519 upwardly in the slot 521, thereby moving the lever assembly 520. Movement of the lever assembly 520 results in crimping of an object disposed in an opening 522 of the lever assembly 520. For example, the lever assembly 520 can include four indenters 531 disposed therein, such that a four-point indention is formed in the crimped object. Movement of the lever assembly 520 causes the four indenters 531 to converge to crimp the object disposed in the opening 522.

A spring member 523 is disposed on the lead screw 514 between the upper collar 518 and the bearing 515, as shown in FIG. 6. A first conventional force transducer 524 is disposed within the nut assembly 526. A second conventional force transducer 525 is disposed between the upper collar 518 and the spring member 523. Preferably, the first and second transducers 524 and 525 are piezo-type transducers, which output a consistent voltage the more the material is compressed. Electrical wiring 527 connects the first transducer 524 to a circuit board 529. Electrical wiring 528 connects the second transducer 525 to the circuit board 529.

A force measurement A is obtained during a crimping procedure by measuring the amount of compression force on the nut assembly 526 with the first transducer 524. A distance measurement B is obtained during the crimping procedure by measuring the force the compressed spring 523 pushes on the second transducer 525. The distance the spring 523 moves during compression can be calculated based on the force detected by the second transducer 525. The force and distance measurements allow operating parameters of the crimp tool 511 to be determined, such as, but not limited to, sensing a complete cycle of the crimp tool, cycle counting, detecting a good or bad crimp, crimp inspection and tool wear detection. The force and displacement measurements are sent to the circuit board 529 such that an audible or visual indication of the crimp can be provided to the user. The crimp tool 511 can also be connected to a computer, such as with a USB cable, to output and save the data.

Figure 7:
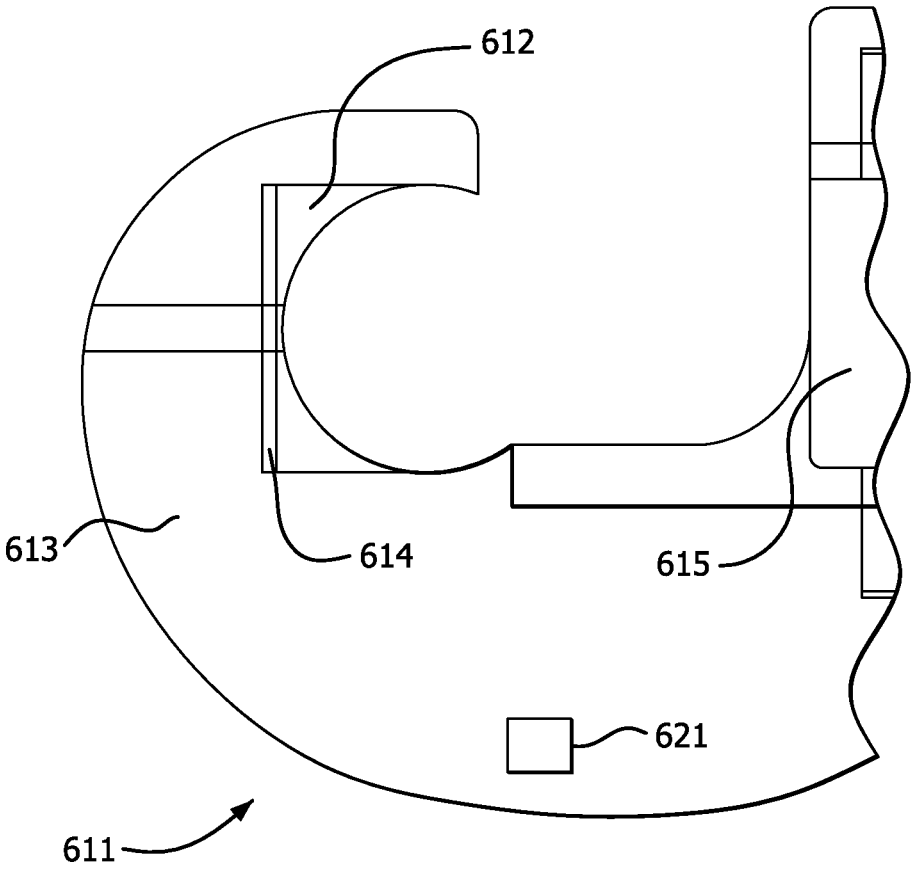
FIG. 7 is a partial side elevational view of a crimp tool in accordance with a seventh exemplary embodiment of the present invention.

A crimp tool 611 in accordance with a seventh exemplary embodiment of the present invention is shown in FIG. 7. An upper die 612 is connected to a frame 613. A conventional force transducer 614 is disposed between the upper die 612 and the frame 613. As a ram 615 is driven to crimp an object with the crimp tool 611, the transducer 614 measures the force acting on the upper die 614. The ram 615 can be hydraulically-driven or by other conventional driving mechanics. The measured force is transmitted to a microprocessor 621 to indicate to a user whether a good or bad crimp was obtained.

Figure 8:
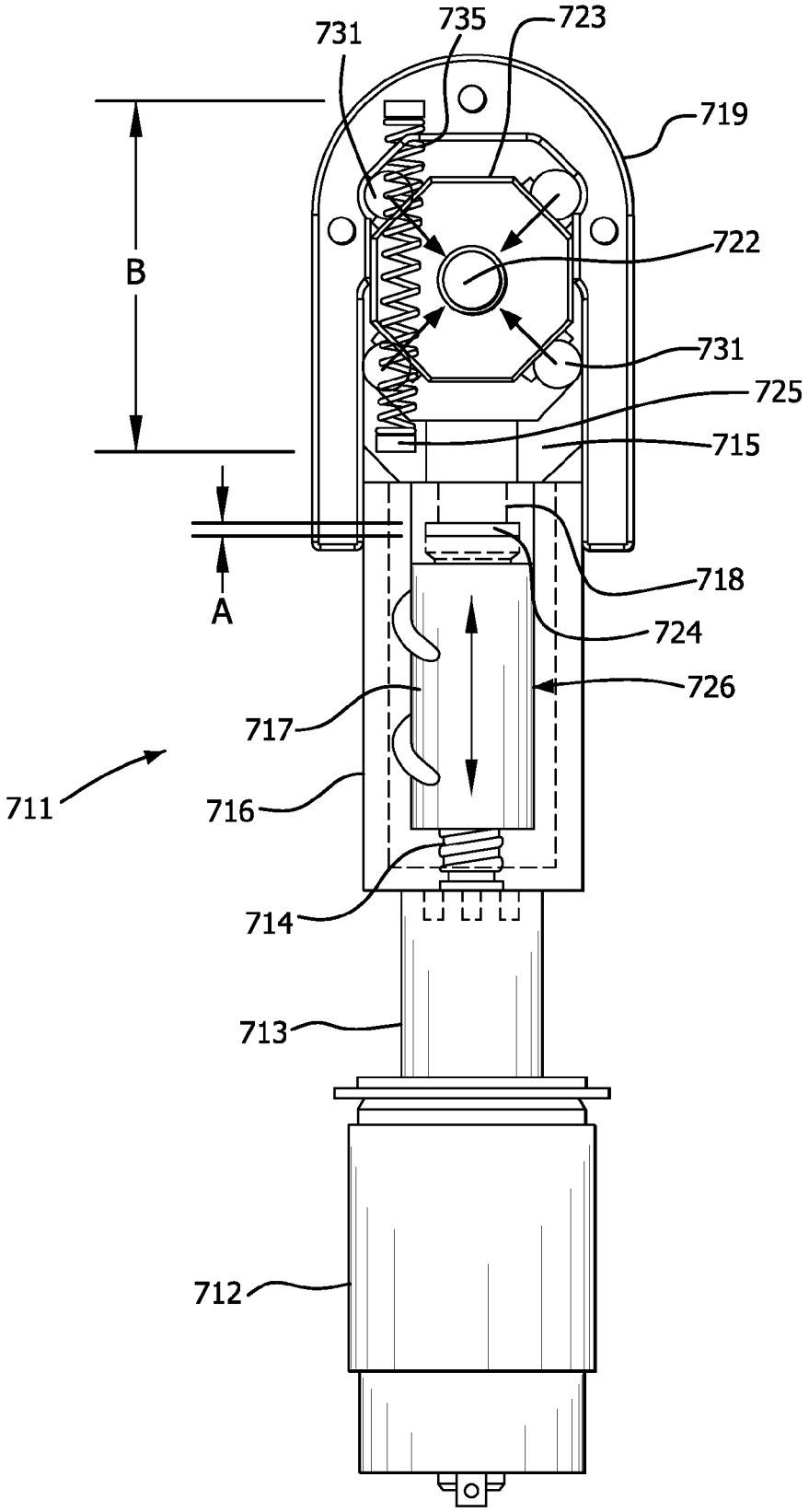
FIG. 8 is a rear elevational view of a crimp tool in accordance with an eighth exemplary embodiment of the present invention.

A powered crimp tool 711 in accordance with an eighth exemplary embodiment of the present invention is shown in FIG. 8. The crimp tool 711 includes a motor 712 that drives a gear box 713. A lead screw 714 is rotatably connected at a first end to the gear box 713 and to a ram 715 at a second end. A nut assembly 726 includes a lower recirculating ball nut 717 and an upper collar 718 fixedly connected to the lead screw 714. The nut assembly 726 and lead screw 714 are movably disposed in a tubular handle 716 disposed between the gear box 713 and the frame 719. The ram 715 is movably disposed in a frame 719.

To crimp an object, such as an electrical connector, disposed in an opening 722 of a crimp head 723, the motor 712 drives the gear box 713 to advance the lead screw 714 upwardly. The upward movement of the lead screw 714 moves the lower ball nut 717 and upper collar 718 upwardly. Movement of the upper collar 718 upwardly moves the ram 715 upwardly in the frame 719.

Four roller indentors 731 disposed in the frame 719 are moved inwardly by the ram 715 toward the opening 722 as indicated by the arrows. The roller indentors 731 are disposed between the frame 719 and the crimp head 723. The upward movement of the ram 715 also moves the crimp head 723 upwardly, thereby driving the roller indentors 731 into the crimp head 723 toward the opening 722 therein. The roller indentors 731 converge toward the opening 722, thereby crimping the object disposed therein. The frame 719 includes four indenters 731 disposed therein, such that a four-point indention is formed in the crimped object.

A spring member 735 is connected between the ram 715 and the frame 719, as shown in FIG. 8. A first conventional force transducer 724 is disposed within the nut assembly 726. A second conventional force transducer 725 is disposed in the ram 715 and connected to the spring member 735. Preferably, the first and second transducers 724 and 725 are piezo-type transducers, which output a consistent voltage the more the material is compressed. Electrical wiring connects the first transducer to a circuit board. Electrical wiring connects the second transducer to the circuit board.

A force measurement A is obtained during a crimping procedure by measuring the amount of compression force on the nut assembly 726 with the first transducer 724. A distance measurement B is obtained during the crimping procedure by measuring the force the compressed spring 735 pushes on the second transducer 725. The distance the spring 735 moves during compression can be calculated based on the force detected by the second transducer 725. The force and distance measurements allow operating parameters of the crimp tool 711 to be determined, such as, but not limited to, sensing a complete cycle of the crimp tool, cycle counting, detecting a good or bad crimp, crimp inspection and tool wear detection. The force and displacement measurements are sent to the circuit board such that an audible or visual indication of the crimp can be provided to the user. The crimp tool 711 can also be connected to a computer, such as with a USB cable, to output and save the data.

Figure 9:
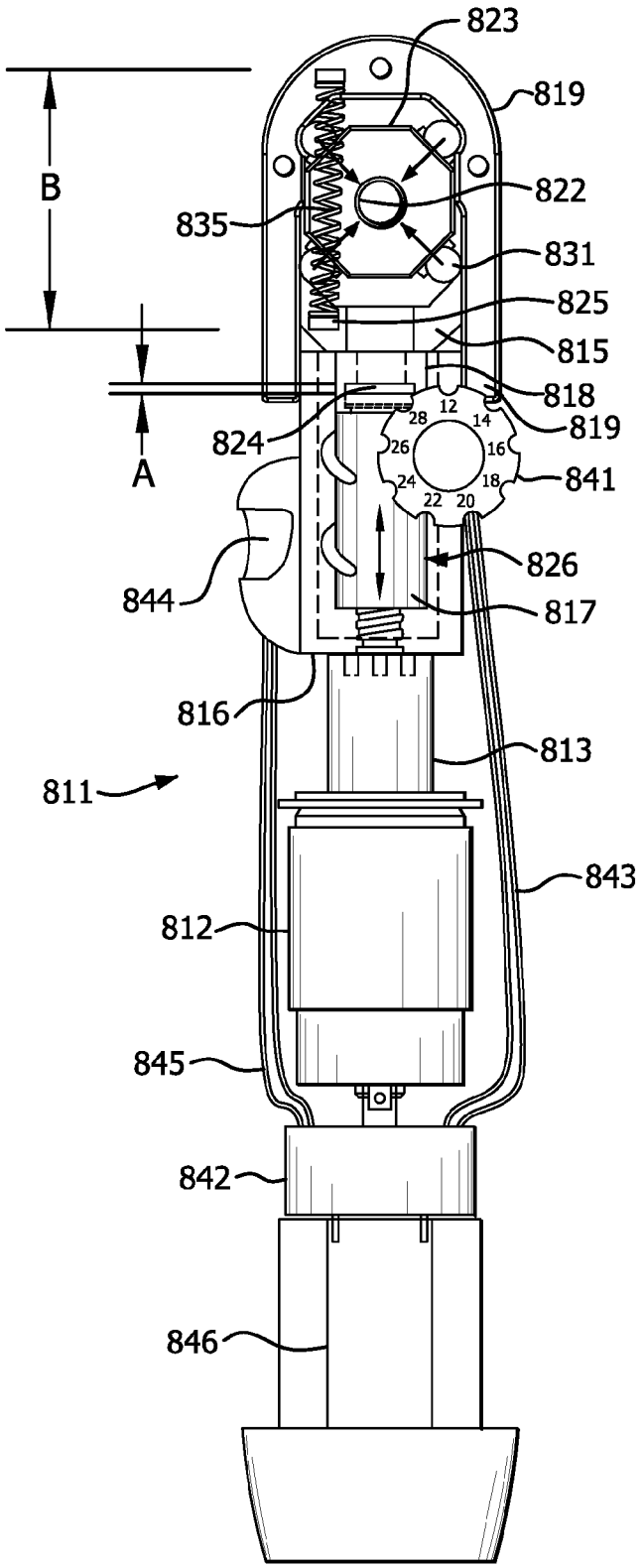
FIG. 9 is a rear elevational view of a crimp tool in accordance with a ninth exemplary embodiment of the present invention having an electrical connector size selector.

A powered crimp tool 811 in accordance with a ninth exemplary embodiment of the present invention is shown in FIG. 9. The crimp tool 811 includes a motor 812 that drives a gear box 813. A lead screw 814 is rotatably connected at a first end to the gear box 813 and to a ram 815 movably disposed in a frame 819. A nut assembly 826 includes a lower recirculating ball nut 817 and an upper collar 818 fixedly connected to the lead screw 814. The nut assembly 826 and lead screw 814 are movably disposed in a tubular handle 816 disposed between the gear box 813 and the frame 819. The ram 815 is movably disposed in the frame 819.

To crimp an object, such as an electrical connector, disposed in an opening 822 of a crimp head 823, the motor 812 drives the gear box 813 to advance the lead screw 814 upwardly. The upward movement of the lead screw 814 moves the lower ball nut 817 and upper collar 818 upwardly. Movement of the upper collar 818 upwardly moves the ram 815 upwardly in the frame 819.

Four roller indentors 831 disposed in the frame 819 are moved inwardly by the upward movement of the ram 815 toward the opening 822 as indicated by the arrows. The roller indentors 831 are disposed between the frame 819 and the crimp head 823. The upward movement of the ram 815 also moves the crimp head 823 upwardly, thereby driving the roller indentors 831 into the crimp head 823 toward the opening 822 therein The roller indentors 831 converge toward the opening 822, thereby crimping the object disposed therein. The frame 819 includes four indenters 831 disposed therein, such that a four-point indention is formed in the crimped object.

A spring member 835 is disposed on the lead screw 814 between the ram 815 and the frame 819, as shown in FIG. 9. A first conventional force transducer 824 is disposed within the nut assembly 826. A second conventional force transducer 825 is disposed within the ram 815 and connected to the spring member 835. Preferably, the first and second transducers 824 and 825 are piezo-type transducers, which output a consistent voltage the more the material is compressed. Electrical wiring connects the first transducer 824 to a circuit board. Electrical wiring connects the second transducer 825 to the circuit board.

A force measurement A is obtained during a crimping procedure by measuring the amount of compression force on the nut assembly 826 with the first transducer 824. A distance measurement B is obtained during the crimping procedure by measuring the force the compressed spring 831 pushes on the second transducer 825. The distance the spring 835 moves during compression can be calculated based on the force detected by the second transducer 825. The force and distance measurements allow operating parameters of the crimp tool 811 to be determined, such as, but not limited to, sensing a complete cycle of the crimp tool, cycle counting, detecting a good or bad crimp, crimp inspection and tool wear detection. The force and displacement measurements are sent to the circuit board such that an audible or visual indication of the crimp can be provided to the user. The crimp tool 811 can also be connected to a computer, such as with a USB cable, to output and save the data.

A connector size selector 841 is electrically connected to a control unit 842 by electrical wiring 843. The connector size selector 841 is preferably a rotatable knob rotatable to a desired setting position. A trigger 844 is electrically connected to the control unit 842 by electrical wiring 845. The selector 841 is set to the desired connector size and a signal is transmitted to the control unit 842 regarding the connector size. Manually operating the trigger 844 sends a crimping signal to the control unit 842. Based on the received signals, the control unit 842 causes the motor 812 to advance the ram 815 to the appropriate position to crimp for the selected connector size. The crimp tool 811 can be powered by a battery 846, as shown in FIG. 9.

Figure 10:
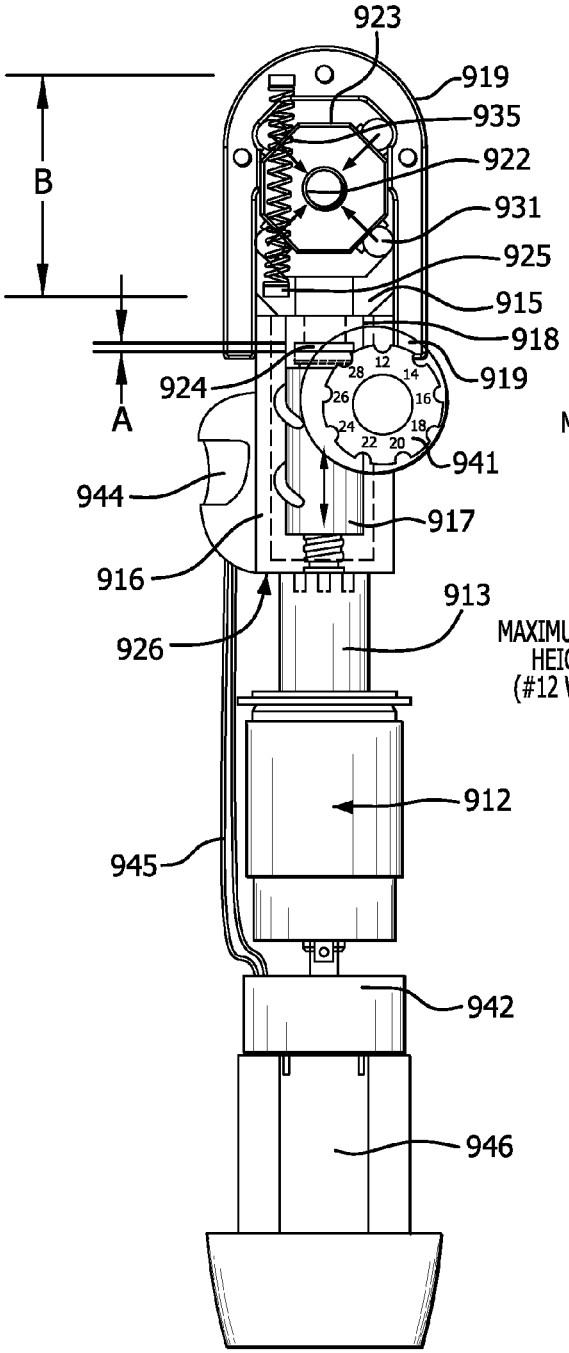
FIG. 10 is a rear elevational view of a crimp tool in accordance with an tenth exemplary embodiment of the present invention having a mechanical connector size selector.
Figure 11:
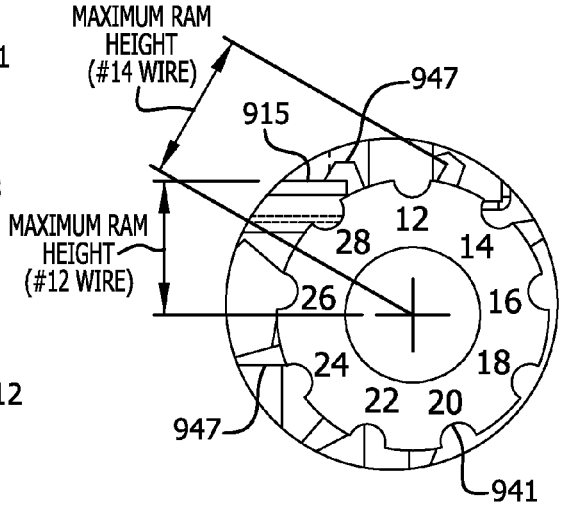
FIG. 11 is an enlarged perspective view of a connector size selector of the crimp tool of FIG. 10.

A crimp tool 911 in accordance with a tenth exemplary embodiment of the present invention is shown in FIGS. 10 and 11. The crimp tool 911 is substantially similar to the crimp tool 811 of the ninth exemplary embodiment shown in FIG. 9 with the exception of the connector size selector as described below. Substantially similar features are indicated with the same base reference numeral except in the 900 series, e.g., "9xx."

A connector size selector 941 is rigidly connected to the frame 919. The connector size selector 941 is preferably a rotatable knob rotatable to a desired setting position. A plurality of hooks 947 are connected to the connector size selector. Each hook is associated with a different available crimp size. A trigger 944 is electrically connected to the control unit 942 by electrical wiring 945. The selector 941 is set to the desired connector size and the appropriate hook 947 engages the collar 918 of the nut assembly 926. Manually operating the trigger 944 sends a crimping signal to the control unit 942. The control unit 942 causes the motor 912 to advance the ram 915 to crimp the object disposed in the opening 922. The hook 947 engaging the collar 918 limits the upward movement of the collar, thereby limiting the upward movement of the ram 915. Each hook 947 has a different size to appropriately limit the distance the ram 915 can advance based on the selected connector size. When a specified force on the ram 915 is sensed by the first transducer 924, a signal is sent to the control unit 942 to shut the motor 912 off.

Measurement of the crimp force is of particular interest while using small mechanical crimp tools (non-hydraulic, non-pneumatic) as there is currently no feedback to the operator. Unlike larger hydraulic and pneumatic tools where a pressure transducer may be employed to measure the operating pressure of a compressible fluid, small hand tools lack this ability because there is no compressible fluid. The transducer in accordance with the exemplary embodiments of the present invention can be strategically placed on a small hand tool to measure the crimping force.

The crimp tools in accordance with the above exemplary embodiments can also include intelligence and data tracking capabilities. For example, each crimp cycle can be counted such that an indicator indicates to the user that calibration is required when a predetermined cycle amount is reached. Additionally, an indicator can indicate when parts should be replaced due to wear based on predetermined cycle amounts. Calibration and repair information, as well as other information regarding use of the tool, can be stored and tracked.

Although described with regard to mechanical tools, the present invention is also applicable to hydraulic and pneumatic tools.

The foregoing embodiment and advantages are merely exemplary and are not to be construed as limiting the scope of the present invention. The description of an exemplary embodiment of the present invention is intended to be illustrative, and not to limit the scope of the present invention. Various modifications, alternatives and variations will be apparent to those of ordinary skill in the art, and are intended to fall within the scope of the invention as defined in the appended claims and their equivalents.

What is claimed is:

1. A crimp tool, comprising:

a frame;

a fixed conductive die connected to said frame;

a movable conductive die connected to said frame;

a first non-conductive member disposed between said frame and said fixed die; and a second non-conductive member disposed between said frame and said movable die; and an electrical component electrically connected to said fixed and movable conductive dies, such that an electrical circuit between said electrical component and said fixed and movable dies is closed during a poor crimp, said first and second non-conductive members prevent said electrical circuit from being closed during a good crimp.

2. The crimp tool according to claim 1, wherein wherein said electrical component is an ohm reader.

3. The crimp tool according to claim 1, wherein complementary surfaces of said first and second non-conductive members extend beyond complementary surfaces of said fixed and movable dies.

* * * * *